US008887520B2

(12) United States Patent
Ueno

(10) Patent No.: US 8,887,520 B2
(45) Date of Patent: Nov. 18, 2014

(54) HEAT EXCHANGER AND AIR CONDITIONER HAVING THE HEAT EXCHANGER MOUNTED THEREIN

(75) Inventor: Madoka Ueno, Osaka (JP)

(73) Assignees: Sharp Kabushiki Kaisha, Osaka-shi, Osaka (JP); Nippon Light Metal Company, Ltd., Tokyo (JP)

( * ) Notice: Subject to any disclaimer, the term of this patent is extended or adjusted under 35 U.S.C. 154(b) by 187 days.

(21) Appl. No.: 13/258,577

(22) PCT Filed: Sep. 14, 2009

(86) PCT No.: PCT/JP2009/066030

§ 371 (c)(1),
(2), (4) Date: Sep. 22, 2011

(87) PCT Pub. No.: WO2010/122684

PCT Pub. Date: Oct. 28, 2010

(65) Prior Publication Data

US 2012/0024509 A1 Feb. 2, 2012

(30) Foreign Application Priority Data

Apr. 22, 2009 (JP) ..... 2009-104218

(51) Int. Cl.

| | |
|---|---|
| ***F25D 21/00*** | (2006.01) |
| ***F28F 17/00*** | (2006.01) |
| ***F28F 1/12*** | (2006.01) |
| ***F28D 1/053*** | (2006.01) |

(52) U.S. Cl.

CPC ..... *F28D 1/05383* (2013.01); *F28F 17/005* (2013.01); *F28F 1/126* (2013.01)

USPC ..... 62/272; 62/281; 62/285

(58) Field of Classification Search

CPC ..... F25D 21/14; F28B 9/08; F28F 17/005

USPC ..... 62/272, 281, 285, 324.5; 165/151–152, 165/172, 148

See application file for complete search history.

(56) References Cited

U.S. PATENT DOCUMENTS 5,253,323 A 10/1993 Koike et al.
6,021,846 A * 2/2000 Sasaki et al. ..... 165/144

(Continued)

FOREIGN PATENT DOCUMENTS

CN 100432579 C 11/2008
CN 102356287 A 2/2012

(Continued)

OTHER PUBLICATIONS

International Search Report for PCT/JP2009/066030 dated Oct. 27, 2009.

*Primary Examiner* — Cassey D Bauer
*Assistant Examiner* — Steve Tanenbaum
(74) *Attorney, Agent, or Firm* — Birch, Stewart, Kolasch & Birch, LLP

(57) ABSTRACT

A heat exchanger (1) is provided with two header pipes (2, 3) arranged parallel to each other with a spacing therebetween, flat tubes (4) arranged between the header pipes (2, 3) and having refrigerant paths (5) provided therein and connected to the insides of the header pipes (2, 3), and corrugated fins (6) arranged between the flat tubes (4). That end of each corrugated fin (6) which is on that surface of the heat exchanger (1) which is on the side on which condensed water collects is made to protrude from ends of the flat tubes (4), and linear water leading members (10) are inserted between gaps (G) between the protrusions. The water leading members (10) are inserted from ends of the corrugated fins (6) toward the flat tube side into a range in which surface tension can act.

3 Claims, 10 Drawing Sheets

(56) References Cited

U.S. PATENT DOCUMENTS

| | | | | |
|---|---|---|---|---|
| 6,273,184 | B1 * | 8/2001 | Nishishita | 165/140 |
| 7,032,313 | B2 * | 4/2006 | Memory et al. | 29/890.047 |
| 7,181,925 | B2 * | 2/2007 | Lee et al. | 62/262 |
| 2008/0202153 | A1 * | 8/2008 | Watanabe | 62/498 |
| 2008/0302131 | A1 * | 12/2008 | Higashiyama | 62/515 |
| 2012/0272677 | A1 | 11/2012 | Furumaki et al. | |

FOREIGN PATENT DOCUMENTS

| | | | |
|---|---|---|---|
| JP | 57-59108 U | * | 4/1982 |
| JP | 60-95482 U | * | 6/1985 |
| JP | 7-55380 A | | 3/1995 |
| JP | 9-101092 A | | 4/1997 |
| JP | 2006-242458 A | | 9/2006 |
| JP | 2007-285673 A | | 11/2007 |
| JP | 2008-292083 A | | 12/2008 |

* cited by examiner

HEAT EXCHANGER AND AIR CONDITIONER HAVING THE HEAT EXCHANGER MOUNTED THEREIN

CROSS REFERENCE TO RELATED APPLICATIONS

This application is the National Phase of PCT International Application No. PCT/JP2009/066030, filed on Sep. 14, 2009, which claims priority under 35 U.S.C. 119(a) to Patent Application No. 2009-104218, filed in Japan on Apr. 22, 2009, all of which are hereby expressly incorporated by reference into the present application.

1. FIELD OF THE INVENTION

The present invention relates to a side-flow type parallel-flow heat exchanger and an air conditioner provided therewith.

2. DESCRIPTION OF THE RELATED ART

A parallel-flow type heat exchanger, having a plurality of flat tubes arranged between a plurality of header pipes such that a plurality of refrigerant passages in the flat tubes communicate with insides of the header pipes, and having fins such as corrugated fins arranged between the flat tubes, is widely used in, for example, vehicle air conditioners or outdoor units of air conditioners for buildings.

An example of conventional side-flow type parallel-flow heat exchangers is shown in FIG. 11. In FIG. 11, the upper side of the sheet is the upper side in the vertical direction and the lower side of the sheet is the lower side in the vertical direction. The heat exchanger 1 is provided with two vertical header pipes 2 and 3 arranged parallel to each other at an interval in the horizontal direction and a plurality of horizontal flat tubes 4 arranged between the header pipes 2 and 3 at predetermined pitches in the vertical direction. The flat tubes 4 are elongate and formed of a metal by extrusion, and inside them are formed refrigerant passages 5 through which refrigerant flows. The flat tubes 4 are arranged such that the extrusion direction, which is also the length direction of the flat tubes 4, is horizontal, and thus the direction in which the refrigerant flows through the refrigerant passages 5 is also horizontal. A plurality of refrigerant passages 5 of a same sectional shape and area are arranged in the depth direction in FIG. 11, so that the vertical section of each of the flat tubes 4 has a harmonica-like shape. Each of the refrigerant passages 5 communicates with the insides of the header pipes 2 and 3. Corrugated fins 6 are disposed between adjacent ones of the flat tubes 4.

The header pipes 2 and 3, the flat tubes 4, and the corrugated fins 6 are all made of a metal having high thermal conductivity, such as aluminum. The flat tubes 4 are fixed to the header pipes 2 and 3, and the corrugated fins 6 are fixed to the flat tubes 4 by brazing or by welding.

In the heat exchanger 1, refrigerant gates 7 and 8 are formed only on the header pipe 3 side. Inside the header pipe 3, two partition panels 9*a* and 9*c* are provided at an interval in the vertical direction. Inside the header pipe 2, a partition 9*b* is provided at the height intermediate between the partition plates 9*a* and 9*c*.

When the heat exchanger 1 is used as an evaporator, the refrigerant flows in through the lower refrigerant gate 7 as shown by a solid line arrow in FIG. 11. The refrigerant that has entered through the refrigerant gate 7 is blocked by the partition panel 9*a* to be directed to the header pipe 2 through some of the flat tubes 4. This flow of the refrigerant is indicated by a left-pointing block arrow. The refrigerant that has entered the header pipe 2 is blocked by the partition panel 9*b* to be directed to the header pipe 3 through different ones of the flat tubes 4. This flow of the refrigerant is indicated by a right-pointing block arrow. The refrigerant that has entered the header pipe 3 is blocked by the partition panel 9*c* to be directed to the header pipe 3 again through still different ones of the flat tubes 4. This flow of the refrigerant is indicated by another left-pointing block arrow. The refrigerant that has entered the header pipe 2 turns around to be directed to the header pipe 3 again through still different ones of the flat tubes 4. This flow of the refrigerant is indicated by another right-pointing block arrow. The refrigerant that has entered the header pipe 3 flows out through the refrigerant gate 8. In this way, the refrigerant flows from bottom to top forming a zigzag passage. Although a case in which three partition panels are used is presented as an example here, this is merely an example, and the number of partition panels and the resulting number of how many times the refrigerant turns around can be designed freely.

When the heat exchanger 1 is used as a condenser, the flow direction of the refrigerant is reversed. That is, the refrigerant flows from top to bottom forming a zigzag passage in the following manner: the refrigerant enters the header pipe 3 through the refrigerant gate 8 as shown by the dotted-line arrow in FIG. 11; the refrigerant that has entered the header pipe 3 is blocked by the partition panel 9*c* to be directed to the header pipe 2 through some of the flat tubes 4; the refrigerant that has entered the header pipe 2 is blocked by the partition panel 9*b* to be directed to the header pipe 3 through different ones of the flat tubes 4; the refrigerant that has entered the header pipe 3 is blocked by the partition panel 9*a* to be directed to the header pipe 2 again through still different ones of the flat tubes 4; the refrigerant that has entered the header pipe 2 turns to be directed to the header pipe 3 again through still different ones of the flat tubes 4; and then the refrigerant flows out through the refrigerant gate 7 as indicated by another dotted-line arrow.

When the heat exchanger is used as an evaporator, moisture in the atmosphere condenses on the cooled surface of the heat exchanger, and thus condensate water is formed. With a parallel-flow heat exchanger, if condensate water stays on the surfaces of flat tubes or of the corrugated fins, a sectional area of the air flow passages is reduced due to the water, and this results in degraded heat exchange performance.

The condensate water is converted to frost on the surface of the heat exchanger if the temperature is low. The conversion may even proceed from frost to ice. In this specification, the term "condensate water" is intended to include within its scope so-called defrost water, that is, water resulting from melting of such frost or ice.

Accumulation of condensate water causes a problem particularly in a side-flow type parallel-flow heat exchanger. Patent Document 1 suggests a method of promoting drainage from a side-flow type parallel-flow heat exchanger.

In the heat exchanger disclosed in Patent Document 1, drainage guides are disposed in contact with corrugated fins on a side of the heat exchanger where condensate water is collected. The drainage guides are linear members, and disposed to be tilted with respect to flat tubes. At least one of the two ends of each drainage guide is led to a lower-end side or a side-end side of the heat exchanger.

CITATION LIST

Patent Literature

Patent Literature 1: JP-A-2007-285673

SUMMARY OF INVENTION

Technical Problem

The drainage guide described in Patent Document 1 itself blocks the flow of air passing between corrugated fins, and this is a cause of the degradation of the heat exchange performance of the heat exchanger. The present invention has been made in view of this problem, and an object of the present invention is to improve the condensate-water drainage capability of a side-flow type parallel-flow heat exchanger without reducing ventilation therethrough. Another object of the present invention is to provide a high-performance air conditioner provided with such a side-flow type parallel-flow heat exchanger.

Solution to Problem

To achieve the above object, according to one aspect of the present invention, a side-flow type parallel-flow heat exchanger is provided with: a plurality of header pipes arranged in parallel with one another at intervals; a plurality of flat tubes disposed between the plurality of header pipes and each having a refrigerant passage formed therein in communication with insides of the header pipes; and corrugated fins disposed between the plurality of flat tubes. Here, edges of the corrugated fins located close to a face of the heat exchanger on a side where condensate water collects are formed as protruding portions that protrude from edges of the plurality of flat tubes; and linear water guide members are inserted from the edges of the flat tubes into gaps between the protruding portions to a depth within a range that surface tension of the condensate water on the protruding portions is exerted on the linear water guide members.

With this structure, the surface tension of the condensate water collected at the edges of the corrugated fins is exerted on the water guide members disposed on the flat tube side, and bridges of the condensate water formed at the edges of the corrugated fins are broken. The bridges of the condensate water are broken one after another like a chain reaction, and the condensate water is quickly drained away. As a result, ventilation through the corrugated fins is not reduced due to condensate water, and thus good heat exchange performance can be obtained. Furthermore, since the water guide members are inserted into the gaps between adjacent ones of the protruding portions of the corrugated fins, the water guide members do not block air from flowing through the corrugated fins.

In the heat exchanger structured as described above, it is preferable that the water guide members be water-absorbent members and be in contact with the edges of the corrugated fins.

This structure facilitates procurement of the water guide members and exertion of the surface tension of condensate water on them.

In the heat exchanger structured as described above, it is preferable that the water guide members be non-water-absorbent members, and that portions of the water guide members on which the surface tension of the condensate water is exerted do not protrude from the edges of the corrugated fins.

With this structure, condensate water is drained away with improved efficiency, and the water guide members are less likely to drop off from the gaps even if they are shaken while being transported or vibration is transmitted thereto from a compressor.

In the heat exchanger structured as described above, it is preferable that the water guide members extend deep enough to fill the gaps from entrances to rear ends of the gaps.

With this structure, the water guide members can be fitted to be in contact with edges of the corrugated fins merely by pushing them in until they hit the rear ends of the gaps, leading to easy assembly. Furthermore, volumes of the water guide members are increased, and this enhances condensate-water attraction performance. Moreover, the water guide members are less likely to drop off from the gaps even if they are shaken while being transported or vibration is transmitted thereto from a compressor.

According to another aspect of the present invention, an air conditioner has the heat exchanger of any one of claims 1 to 4 incorporated in an outdoor unit.

With this structure, it is possible to provide a high-performance air conditioner having an outdoor unit in which ventilation through the heat exchanger is less likely to be reduced due to condensate water.

According to another aspect of the present invention, an air conditioner has the heat exchanger of any one of claims 1 to 4 incorporated in an indoor unit.

With this structure, it is possible to provide a high-performance air conditioner having an indoor unit in which ventilation through the heat exchanger is less likely to be reduced due to condensate water.

Advantageous Effects of Invention

According to the present invention, the surface tension of condensate water collected at the edges of the corrugated fins is exerted on the water guide members disposed on the flat tube side, and bridges that the condensate water forms at the edges of the corrugated fins are broken. The bridges of the condensate water are broken one after another like a chain reaction, and the condensate water is quickly drained away. Besides, since the water guide members are positioned such that they do not block air from flowing through the corrugated fins, the amount of air passing through the corrugated fins is less likely to be reduced due to condensate water, and thus good heat-exchange performance of the heat exchanger can be constantly secured.

DETAILED DESCRIPTION OF THE INVENTION

Figure 11:
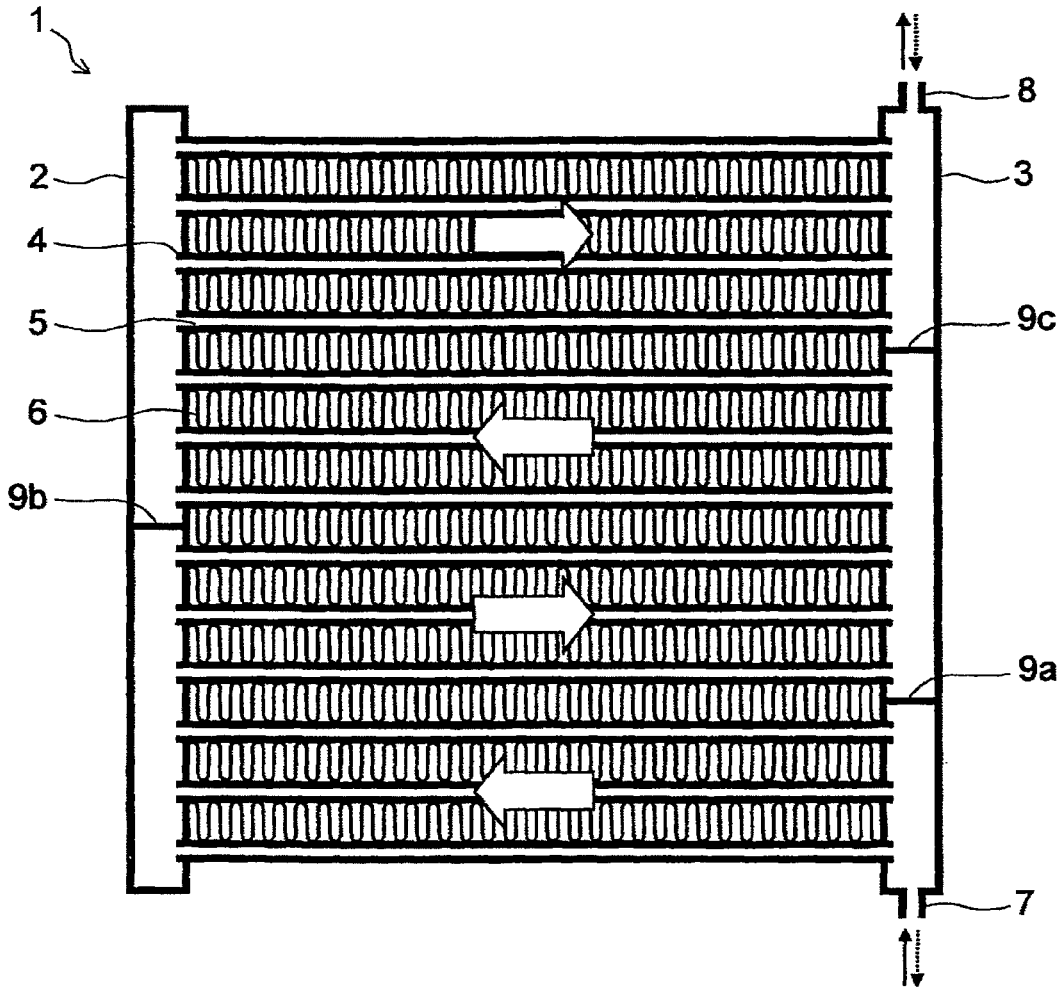
FIG. 11 A vertical sectional view schematically showing the structure of a conventional side-flow type parallel-flow heat exchanger.

Hereinafter, embodiments of the present invention will be described with reference to the drawings. Components similar in function to those in FIG. 11 showing the conventional structure are identified by the same reference numbers as in FIG. 11, and descriptions thereof will be omitted.

Figure 1:
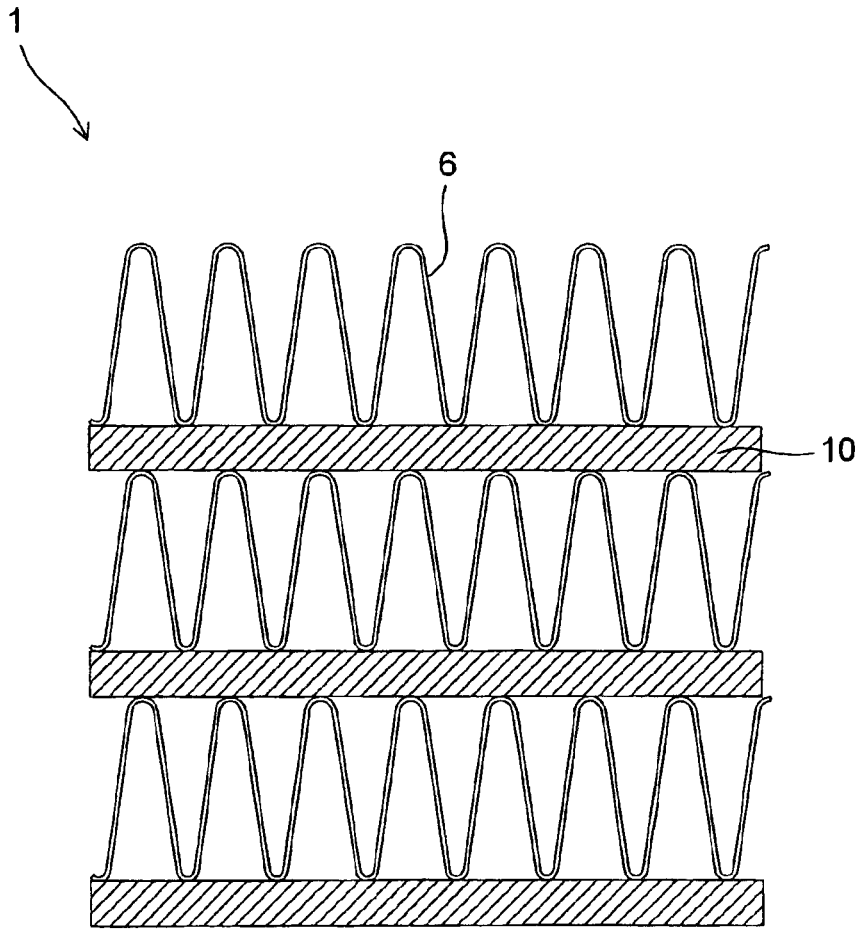
FIG. 1 A front view showing part of a heat exchanger embodying the present invention.
Figure 2:
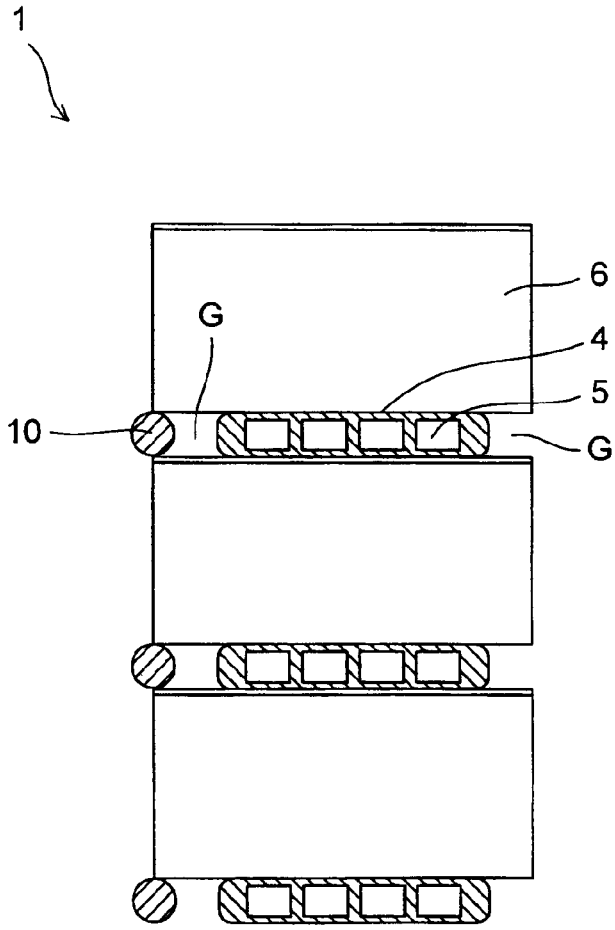
FIG. 2 An enlarged partial sectional view of the heat exchanger shown in FIG. 1.
Figure 3:
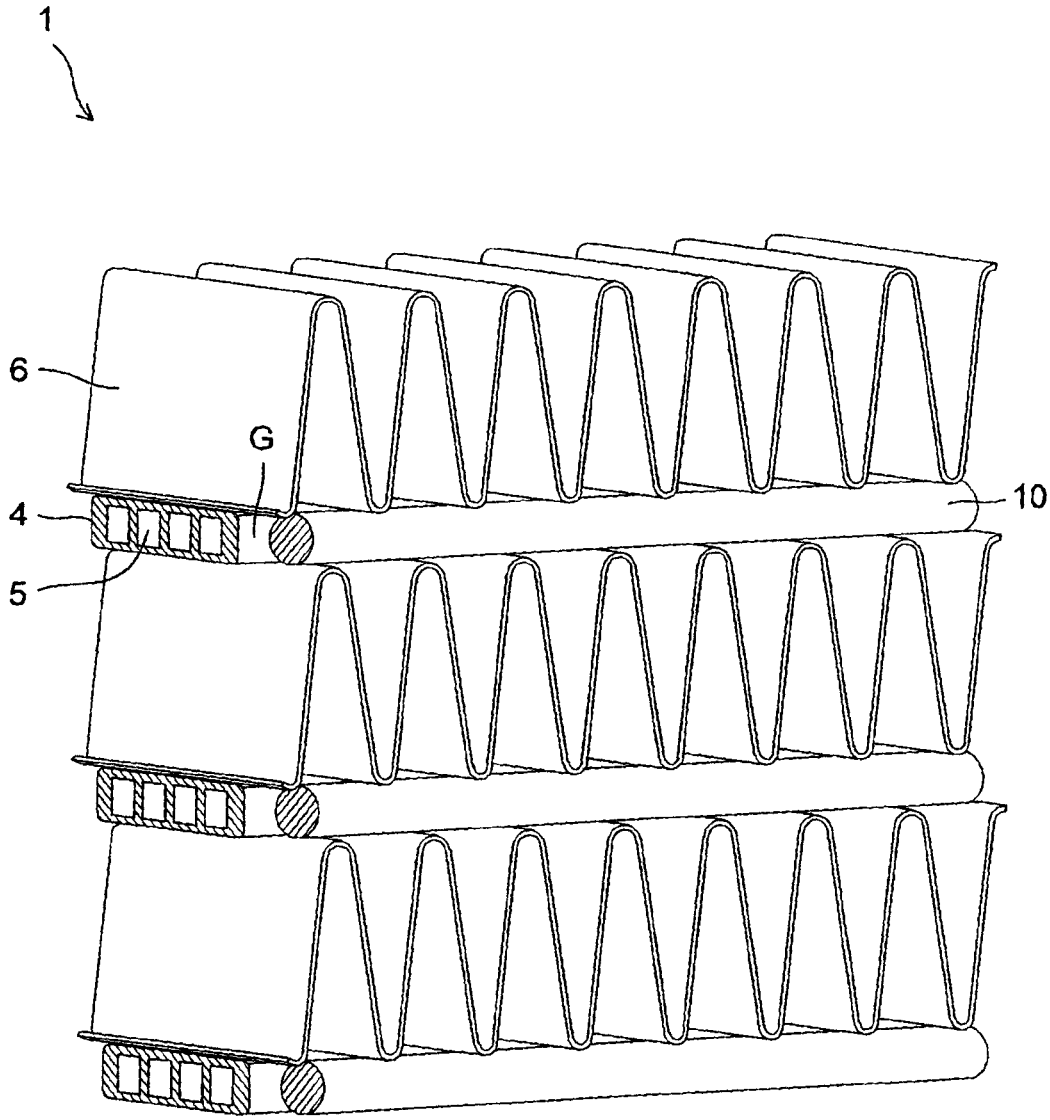
FIG. 3 An enlarged partial perspective view of the heat exchanger shown in FIG. 1.

FIGS. 1 to 3 each show the structure of part of a side-flow type parallel-flow heat exchanger 1. A plurality of linear water guide members 10 are arranged at predetermined intervals on a condensate-water-collection side face of the heat exchanger 1. Each of the water guide members 10 is an assembly of fibers (preferably, synthetic fibers), that is, a so-called "cord".

As shown in FIGS. 2 and 3, edges of the corrugated fins 6 protrude from edges of the flat tubes 4. The water guide members 10 are inserted into gaps G between the protruding portions. The depth of the insertion should be such that water accumulated at the edges of the corrugated fins 6 can maintain its surface tension exerted on the water guide members. In this embodiment, the water guide members 10 are inserted into all of the gaps G between the protruding portions of the corrugated fins 6.

The water guide members 10 disposed in this way allow smooth drainage of condensate water away from the corrugated fins 6, attracting the condensate water collected on the corrugated fins 6. The mechanism of the attraction is as follows.

When condensate water is accumulated at the edges of the corrugated fins 6, a bridging phenomenon (formation of a water film) occurs in planes between the edges of the corrugated fins 6 due to surface tension of the condensate water. A bridging phenomenon occurs in planes not only between the edges of the corrugated fins 6 but also between the water guide members 10 inserted under the corrugated fins 6 and the edges of the corrugated fins 6. In addition, a bridging phenomenon occurs also in planes between the water guide members 10 and condensate water accumulated at the edges of the corrugated fins 6 located under the water guide members 10. The series of bridging phenomena form a water guide passage from the upper portion to the lower portion of the heat exchanger 1, and this helps force the condensate water forming bridges among the corrugated fins 6 to flow downward.

The surface tension of the condensate water, exerted on the corrugated fins 6, or on the edges of the corrugated fins 6 and the water guide members 10, takes various values with parameter such as the pitch of the corrugated fins 6, the arrangement pitch of the flat tubes 4, and the amount of protrusion of the corrugated fins 6. It is desirable that how deep the water guide members 10 are to be inserted be determined, based on experiments, such that surface tension of condensate water is securely exerted on the edges of the corrugated fins 6 and on the water guide members 10.

With the above-described drainage mechanism, ventilation of the corrugate fins 6 is not reduced due to condensate water, and this helps the heat exchanger 1 constantly offer good heat exchange performance. Also, since the water guide members 10 are inserted into the gaps formed between the protruding portions of the corrugated fins 6, the water guide members 10 themselves do not block air from flowing through the corrugated fins 6.

In a case in which the water guide members 10 are each an assembly of fibers, if each of the fibers is water-absorbent, when the fibers in a dry state come in contact with water, the fibers absorb the water therein. As a result, apparent diameters of the fibers increase. On the other hand, in a case in which the fibers themselves are not water-absorbent, if they are assembled together in a bundle like a yarn, a capillary phenomenon occurs in each gap between the fibers, and this gives the water guide members 10 a water-absorbent characteristic. Water films are formed on the surfaces of the fibers when the water guide members 10, which are thus provided with a water-absorbent characteristic derived from the characteristic of the fibers themselves or of the fibers as a bundle, absorbs water.

When, with water films formed on the surfaces of the fibers of the water guide members 10, condensate water is accumulated at the edges of the corrugated fins 6 and a bridging phenomenon occurs, the condensate water that has caused the bridging phenomenon is united with the water films formed on the surfaces of the fibers of the water guide members 10 due to surface tension. Thus, it is possible to break the surface tension of the condensate water that has caused the bridging phenomenon on the corrugated fins 6.

Furthermore, when a bridging phenomenon of condensate water occurs at the edges of the corrugated fins 6 located under the water guide members 10, the condensate water that has caused the bridging phenomenon is united with the water films formed on the surfaces of the fibers of the water guide members 10 due to surface tension. Thus, via the water films formed on the surface of the fibers, the water films that have formed bridges are connected one after another, and thereby a water passage is formed. As a result, although the condensate water causes the bridging phenomenon, the water films forming the bridges are broken immediately, and thereby the condensate water is quickly drained away.

The water guide members 10 consisted of water-absorbent members (open-cell resin foam, for example), as well as those formed as a bundle of fibers, have water films developed on their surfaces when they absorb water. Thus, as in the case of the water guide members 10 formed as a bundle of fibers, water-film breaking effect is applied to the condensate water that has caused the bridging phenomenon, and thereby the condensate water can be quickly drained away.

As described above, in the drainage mechanism with the water guide members 10 consisted of water-absorbent members, it is essential that water films are formed on the surfaces of the water guide members 10 when the water guide members 10 absorb water. For this reason, in the case in which the water guide members 10 are consisted of water-absorbent members, it is desirable that the water guide members 10 be in contact with the edges of the corrugated fins 6 as shown in FIG. 2. It is also preferable that the water guide members 10 somewhat protrude from the edges of the corrugated fins 6. With this structure, the contact area between the water guide members 10 and the corrugated fins 6 is increased, and this allows the water guide members 10 to absorb water with ease. In addition, this structure allows easy contact between the water guide members 10 and water forming bridges at the ends of the corrugated fins 6.

The water guide members 10 are not limited to water-absorbent members. The water guide members 10 may be non-water-absorbent members as long as they allow condensate water that has caused a bridging phenomenon at the edges of the corrugated fins 6 to exert surface tension on them. Examples of such water guide members 10 are shown in FIGS. 5 to 8.

Figure 5:
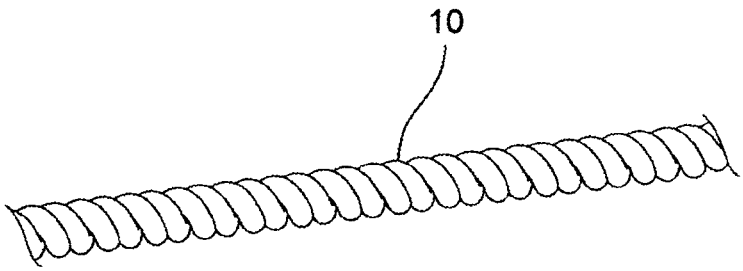
FIG. 5 A perspective view showing an example of water guide member other than those shown in the above figures.

The water guide member 10 shown in FIG. 5 is formed as a double-helix-shaped member made of wires or synthetic resin filaments twisted on each other.

In a case in which the water guide members 10 are non-water-absorbent members formed of metal or the like, the water drainage mechanism is somewhat different from in the case in which they are water-absorbent members. A description will be given in this respect, taking up the water guide members 10 each formed as shown in FIG. 5 as a representative example.

With the water guide members 10 each formed as shown in FIG. 5, the water films of the bridges are also broken by surface tension that condensate water exerts on the water guide members 10. However, the water guide members 10 each formed as shown in FIG. 5 are non-water-absorbent, and thus do not absorb water therein. This eliminates the need of the water guide members 10 being located such that they can absorb water easily, and they only need to be located such that the condensate water forming water films at the edges of the corrugated fins 6 can exert surface tension on the water guide members 10. In the case of the water guide members 10 each formed as shown in FIG. 5, surface tension is exerted on double helix grooves, and thereby a water passage is formed.

Thus, the water guide members 10 each formed as shown in FIG. 5 do not need to be in contact with the edges of the corrugated fins 6. This makes it possible to insert the water guide members 10 toward the rear ends of the gaps G as much as possible within a range satisfying the condition that the water guide members 10 are located such that the condensate water forming water films at the edges of the corrugated fins 6 can exert surface tension on the water guide members 10. If the water guide members 10 are inserted deep into the gaps G and thus the portions of the water guide members 10 on which surface tension is exerted do not protrude from the edges of the corrugated fins 6, condensate water can be drained away with improved efficiency, and in addition, the water guide members 10 are less likely to drop off from the gaps G even if they are shaken while being transported or vibration is transmitted thereto from a compressor.

The surface tension of the condensate water that is exerted with respect to the water guide members 10 takes various values with parameter such as the width of the double helix grooves and the diameter of the water guide members 10. It is desirable that how deep the water guide members 10 are to be inserted be determined, based on experiments, such that surface tension of condensate water is securely exerted on the edges of the corrugated fins 6 and on the water guide members 10.

Figure 6:
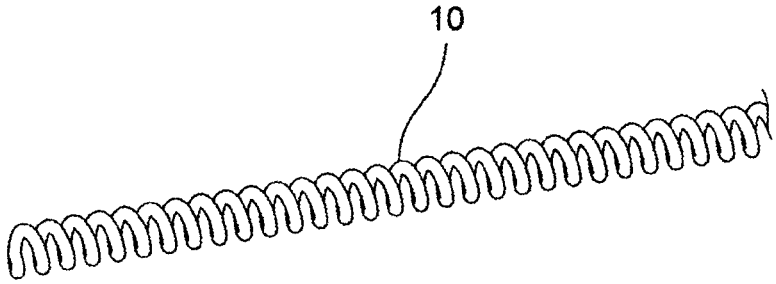
FIG. 6 A perspective view showing still another example of the water guide member.

The water guide member 10 shown in FIG. 6 is formed by twisting wires or synthetic resin filaments in the shape of a coil spring. In the water guide member 10 formed in this shape, the surface tension of the condensate water is exerted on gaps in the coil spring.

Figure 7:
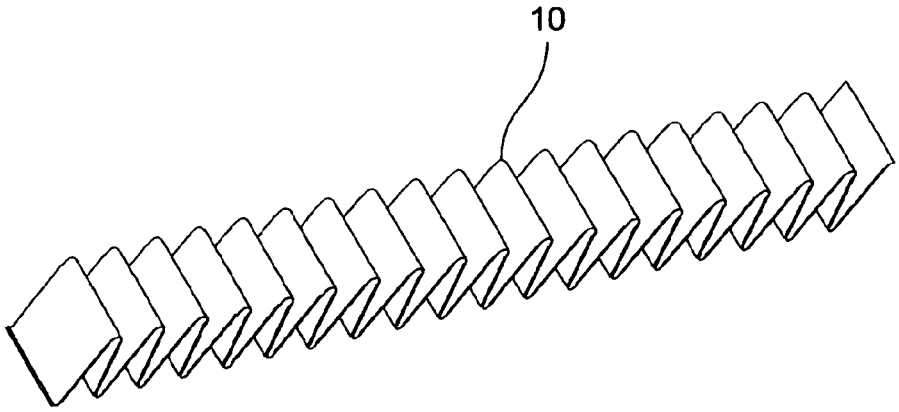
FIG. 7 A perspective view showing still another example of the water guide member.

The water guide member 10 shown in FIG. 7 is made by forming a metal or a synthetic resin plate into a fine-pitch corrugated panel. In the water guide member 10 having this shape, the surface tension of the condensate water is exerted on gaps between corrugations of the corrugated panel.

Figure 8:
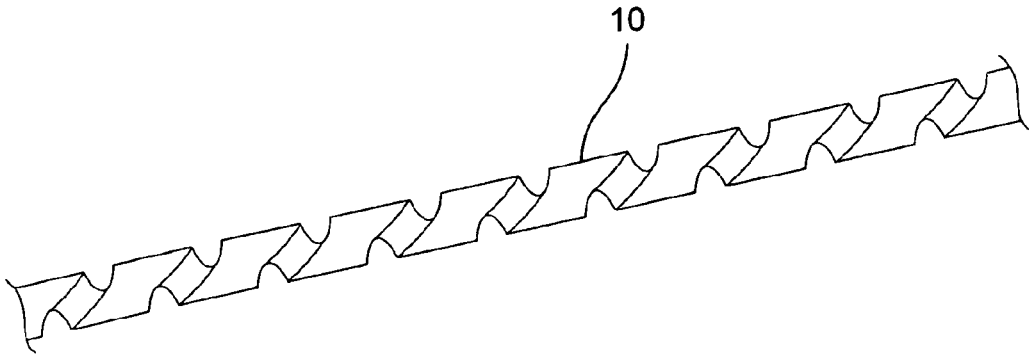
FIG. 8 A perspective view showing still another example of the water guide member.

The water guide member 10 shown in FIG. 8 is formed in the shape of a drill bit by carving a spiral groove in the outer circumference of a metal or a synthetic-resin rod. In the water guide member 10 formed in this shape, the surface tension of the condensate water is exerted with respect to the spiral groove.

In addition to the hitherto described water-absorbent and non-water-absorbent members, various other types of water-absorbent and non-water-absorbent members allowing condensate water to exert surface tension on them can be used as the water guide members, such as those made of a porous substance such as a sponge (water-absorbent members), and those formed in the shape of a braid of cords, a chain, or the like.

Figure 4A:
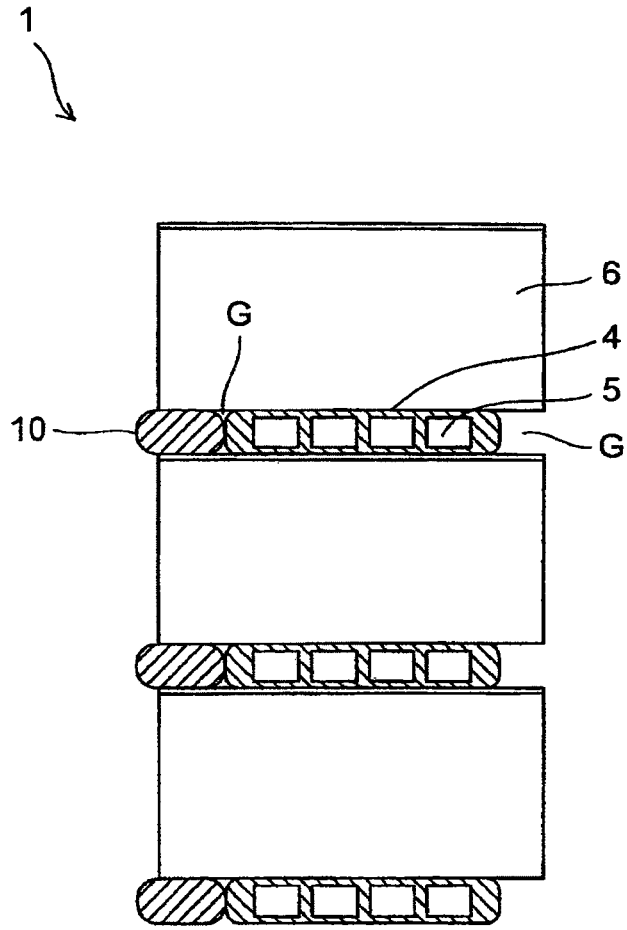
FIG. 4(*a*) is an enlarged partial sectional view of a modified example of the heat exchanger shown in FIG. 1, and FIG. 4(*b*) is an enlarged partial sectional view of another modified example of the heat exchanger shown in FIG. 1.
Figure 4B:
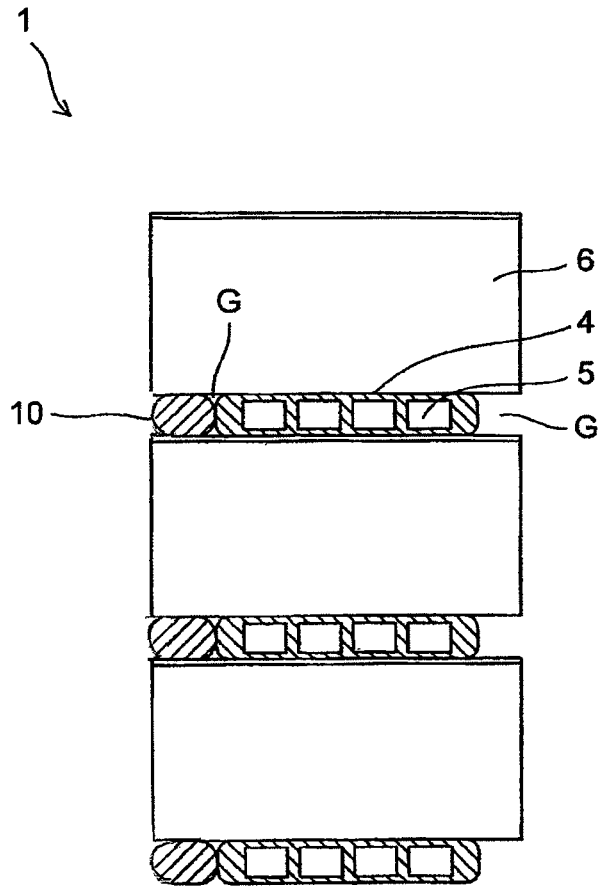

In a modified example shown in FIG. 4(*a*), the water guide members 10 extend deep enough to reach the rear ends of the gaps G from the entrances thereof. With this structure, just by pushing the water guide members 10 toward the rear ends of the gaps G, the water guide members 10 can be fitted at positions on which condensate water that has caused a bridging phenomenon at the edges of the corrugated fins 6 can exert surface tension on the water guide members 10. This leads to an easy assembly operation without the need of paying special attention to the depth of the insertion of the water guide members 10. In addition, apparent volumes of the water guide members 10 are increased, and this allows condensate water to easily exert surface tension on the water guide members 10. Furthermore, the water guide members 10 are less likely to drop off from the gaps even if they are shaken while being transported or vibration is transmitted thereto from a compressor. FIG. 4(*b*) is another modified example where portions of the water guide member does not protrude from the edges of the corrugated fins 6.

Figure 9:
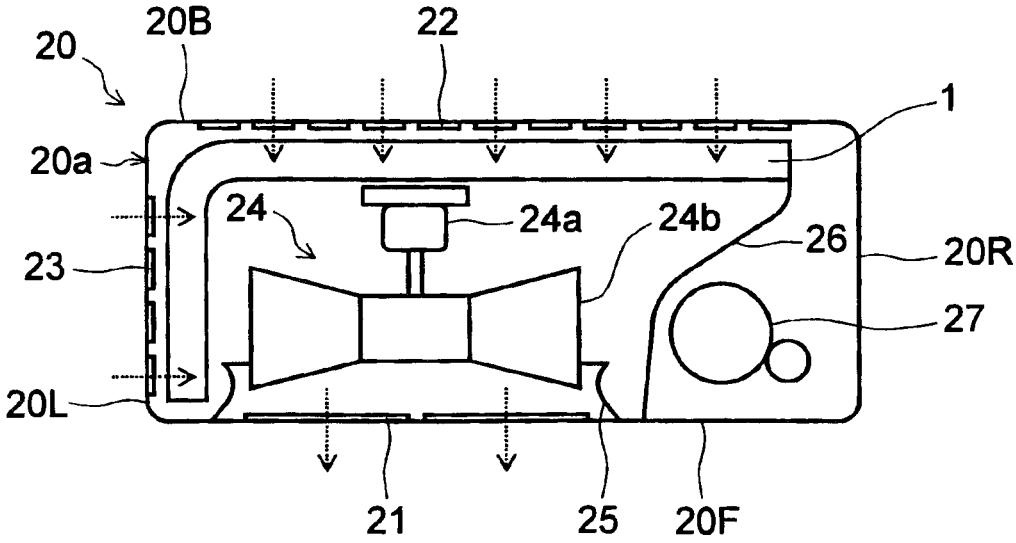
FIG. 9 A schematic sectional view showing an outdoor unit of an air conditioner incorporating the heat exchanger of the present invention.
Figure 10:
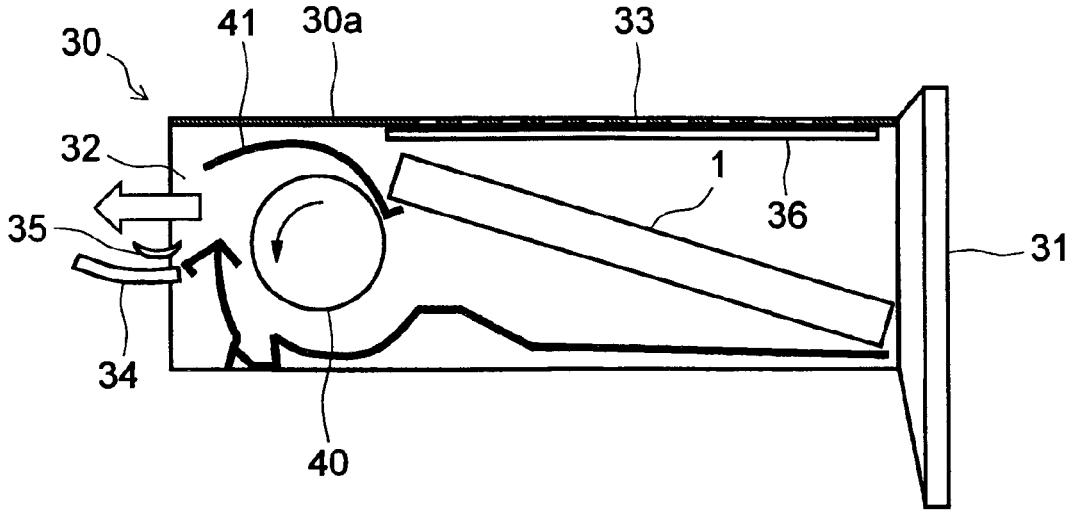
FIG. 10 A schematic sectional view showing an indoor unit of an air conditioner incorporating the heat exchanger of the present invention.

The heat exchanger 1 can be incorporated in the outdoor or indoor unit of a separate type air conditioner. FIG. 9 shows an example where the heat exchanger 1 is incorporated in the outdoor unit of a separate type air conditioner, and FIG. 10 shows an example where the heat exchanger 1 is incorporated in the indoor unit of a separate type air conditioner.

The outdoor unit 20 shown in FIG. 9 is provided with a sheet-metal housing 20*a* that is substantially rectangular in plan, longer sides of the housing 20*a* constitute a front face 20F and a back face 20B, and shorter sides thereof constitute a left-side face 20L and a right-side face 20R. An exhaust port 21 is formed in the front face 20F, a back-face inlet port 22 is formed in the back face 20B, and a side-face inlet port 23 is formed in the left-side face 20L. The exhaust port 21 is an assembly of a plurality of horizontal slit-shaped openings, and the back-face inlet port 22 and the side-face inlet port 23 are lattice-shaped openings. The four sheet-metal members of the front face 20F, the back face 20B, the left-side face 20L, and the right-side face 20R, together with unillustrated top and bottom panels, form the housing 20*a*, which is hexahedral in shape.

Inside the housing 20*a*, a heat exchanger 1 that is L-shaped in plan is disposed immediately close to the back-face inlet port 22 and the side-face inlet port 23. A blower 24 is disposed between the heat exchanger 1 and the exhaust port 21 for the purpose of forcibly performing heat exchange between the heat exchanger 1 and outdoor air. The blower 24 is built as a combination of an electric motor 24*a* and a propeller fan 24*b*. Inside the housing 20*a*, behind the front face 20F, a bell mouth 25 is fitted surrounding the propeller fan 24*b* for improved blowing efficiency. Inside the housing 20*a*, a compressor 27 is accommodated in a space behind the right-side face 20R, the space being isolated by a partition wall 26 from an air flow flowing from the back-face inlet port 22 to the exhaust port 21.

Condensate water formed in the heat exchanger 1 of the outdoor unit 20 reduces the area of the air flow passage, and this causes the heat-exchange performance of the heat exchanger 1 to deteriorate. Furthermore, when outdoor temperature is below the freezing point, the condensate water may freeze and causes damage to the heat exchanger 1. Thus, drainage of condensate water from the heat exchanger 1 is a crucial problem to be solved in the outdoor unit 20.

In the outdoor unit 20, condensate water is collected on the windward side of the heat exchanger 1. This is because the heat exchanger 1 disposed in the outdoor unit 20 does not lean but stands substantially upright. When the heat exchanger 1 is used as an evaporator (as in heating operation), heat exchange is performed more actively on the windward side than on the leeward side, and condensate water is accumulated on the windward side. Thus, the windward side of the heat exchanger 1 constitutes a condensate-water collecting side.

Condensate water formed on the windward side rarely flows toward the leeward side. When the outdoor temperature is low, condensate water is frozen on the heat exchanger 1 as frost. An increased amount of frost necessitates a defrosting operation. The blower 24 does not operate during the defrosting operation, and thus water resulting from the defrosting operation flows mainly downward due to gravity without being affected by wind. Thus, provision of the water guide members 10 at a face on the windward side contributes to quick drainage of condensate water, and prevents the heat exchanging performance from being degraded.

An indoor unit 30 shown in FIG. 10 is provided with a housing 30*a* formed in a rectangular parallelepiped that is thin in the vertical direction. The housing 30*a* is fitted to an unillustrated wall surface inside a room via a base 31 fixed to a rear face of the housing 30*a*. The housing 30*a* has an outlet port 32 in a front face thereof, and has an inlet port 33 in a top face thereof. The inlet port 33 is an assembly of a plurality of slits or an opening partitioned in a lattice shape. A cover 34 and a wind deflection plate 35 are provided in the outlet port 32. The cover 34 and the wind deflection plate 35 both rotate in a vertical plane to be horizontal (open state) when the air conditioner is in operation, and to be vertical (closed state) when the air conditioner is out of operation. Inside the indoor unit 30, a filter 36 is disposed behind the inlet port 33.

A cross-flow fan 40 for forming an outlet air flow is disposed behind the outlet port 32 with an axis of the cross-flow fan horizontal. The cross-flow fan 40 is accommodated in a fan casing 41 and made to rotate in the direction indicated by an arrow in FIG. 10 by an unillustrated electric motor to form an air flow flowing from the inlet port 33 to be discharged from the outlet port 32.

A heat exchanger 1 is disposed behind the cross-flow fan 40. The heat exchanger 1 is disposed within the height of the fan casing 41, in a tilted state with the cross-flow fan 40 side thereof high.

In the indoor unit 30, the lower face of the heat exchanger 1, which is also the leeward side, constitutes a condensate-water collecting side. Water guide members 10 are disposed in the leeward-side face of the heat exchanger 1.

It should be understood that the embodiments specifically described above are not meant to limit the present invention, and that many variations and modifications can be made within the spirit of the present invention.

INDUSTRIAL APPLICABILITY

The present invention is widely applicable to side-flow type parallel-flow heat exchangers.

LIST OF REFERENCE SYMBOLS

1 heat exchanger
2, 3 header pipes
4 flat tube
5 refrigerant passage
6 corrugated fin
G gap
7, 8 refrigerant gate
10 water guide member
20 outdoor unit
30 indoor unit

The invention claimed is:

1. A side-flow type parallel-flow heat exchanger, comprising:

a plurality of header pipes arranged in parallel with one another at intervals;

a plurality of horizontal fiat tubes disposed between the plurality of header pipes and each having a horizontal refrigerant passage formed therein in communication with insides of the header pipes; and corrugated fins disposed between the plurality of flat tubes, wherein edges of the corrugated fins located close to a face of the heat exchanger on a side where condensate water collects are formed as protruding portions that protrude from edges of the plurality of fiat tubes;

linear water guide members are situated into gaps between the protruding portions to a depth within a range that surface tension of the condensate water on the protruding portions is exerted on the linear water guide members; and each of the water guide members comprises a single flat member formed of a water-absorbent member, extends deep enough to reach one of the plurality of flat tubes, and is situated at a point that the water guide member is in contact with an edge of the one of the plurality of flat tubes extending between adjacent corrugated fins, the edge of the flat tube is parallel to the refrigerant passage, and wherein the water guide members are in contact with the edges of the corrugated fins and protrude from the edges of the corrugated fins.

2. An air conditioner, wherein the heat exchanger of claim 1 is incorporated in an outdoor unit.

3. An air conditioner, wherein the heat exchanger of claim 1 is incorporated in an indoor unit.

* * * * *